US012788064B2

(12) United States Patent
Wang et al.

(10) Patent No.: US 12,788,064 B2
(45) Date of Patent: Nov. 10, 2026

(54) AIR-LIQUID EXCHANGE ELEMENT AND AEROSOL CARTRIDGE

(71) Applicant: MICROPOROUS TECHNOLOGY (NINGBO) LIMITED, Zhejiang (CN)

(72) Inventors: Liping Wang, Zhejiang (CN); Xingfu Zhou, Zhejiang (CN); Ding Shen, Zhejiang (CN)

(73) Assignee: MICROPOROUS TECHNOLOGY (NINGBO) LIMITED, Zhejiang (CN)

( * ) Notice: Subject to any disclaimer, the term of this patent is extended or adjusted under 35 U.S.C. 154(b) by 369 days.

(21) Appl. No.: 18/578,732

(22) PCT Filed: Nov. 18, 2021

(86) PCT No.: PCT/CN2021/131580
§ 371 (c)(1),
(2) Date: Mar. 13, 2024

(87) PCT Pub. No.: WO2023/284214
PCT Pub. Date: Jan. 19, 2023

(65) Prior Publication Data

US 2024/0315335 A1 Sep. 26, 2024

(30) Foreign Application Priority Data

Jul. 12, 2021 (CN) ..... 202110785450.6

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/40* (2020.01); *A24F 40/42* (2020.01);
(Continued)

(58) Field of Classification Search
CPC ..... A24F 40/44; A24F 40/10; A24F 40/485; A24F 40/40; A24F 40/42; A24F 40/46; A24F 40/48; D02G 3/36
(Continued)

(56) References Cited

U.S. PATENT DOCUMENTS

2017/0233114 A1* 8/2017 Christensen ..... B65B 3/14 141/2
2021/0030066 A1 2/2021 Xiao et al.

FOREIGN PATENT DOCUMENTS

CN 111434252 7/2020
CN 111528525 8/2020
(Continued)

OTHER PUBLICATIONS

"International Search Report (Form PCT/ISA/210) of PCT/CN2021/131580," mailed on Apr. 14, 2022, with English translation thereof, pp. 1-5.

*Primary Examiner* — Jennifer Dieterle
*Assistant Examiner* — Miriam N Ezeluomba
(74) *Attorney, Agent, or Firm* — Cherskov Flaynik & Gurda, LLC

(57) ABSTRACT

An air-liquid exchange element and an aerosol cartridge are disclosed. The air-liquid exchange element comprises an air-liquid exchange element capillary pore axially penetrating through the air-liquid exchange element and an air-liquid exchange element body constituting a peripheral wall of the air-liquid exchange element capillary pore, the air-liquid exchange element body is made by bonding fibers. The air-liquid exchange element according to the present invention is small in size and simple in structure, and is very suitable for using in an aerosol cartridge with a small space.

13 Claims, 5 Drawing Sheets

(51) Int. Cl.

| | |
|---|---|
| ***A24F 40/40*** | (2020.01) |
| ***A24F 40/42*** | (2020.01) |
| ***A24F 40/46*** | (2020.01) |
| ***A24F 40/48*** | (2020.01) |
| ***A24F 40/485*** | (2020.01) |
| ***D02G 3/36*** | (2006.01) |

(52) U.S. Cl.
CPC ..... *A24F 40/46* (2020.01); *A24F 40/48* (2020.01); *A24F 40/485* (2020.01); *D02G 3/36* (2013.01)

(58) Field of Classification Search
USPC ..... 261/99
See application file for complete search history.

(56) References Cited

FOREIGN PATENT DOCUMENTS

| | | | | | |
|---|---|---|---|---|---|
| CN | 111528525 | A | * | 8/2020 | ..... A24F 40/485 |
| CN | 111759010 | | | 10/2020 | |
| CN | 111759010 | A | * | 10/2020 | ..... A24F 40/485 |
| CN | 211631799 | | | 10/2020 | |
| CN | 212306806 | | | 1/2021 | |

* cited by examiner

AIR-LIQUID EXCHANGE ELEMENT AND AEROSOL CARTRIDGE

CROSS-REFERENCE TO RELATED APPLICATION

This application is a 371 of international application of PCT application serial no. PCT/CN2021/131580, filed on Nov. 18, 2021, which claims the priority benefit of China application no. 202110785450.6, filed on Jul. 12, 2021. The entirety of each of the above mentioned patent applications is hereby incorporated by reference herein and made a part of this specification.

TECHNICAL FIELD

The present application relates to an air-liquid exchange element and an aerosol cartridge using the air-liquid exchange element, and more particularly to an air-liquid exchange element and an aerosol cartridge using the air-liquid exchange element, which are used in the application fields such as electronic cigarettes and drug solution atomization.

BACKGROUND

Techniques for atomizing or vaporizing liquid by heating with ultrasonic or electrical are widely applied to the fields such as electronic cigarettes and the like. A common technology for electronic atomization cigarettes is heating an atomizer which is in direct communication with cigarette oil, so that nicotine is atomized together with a solvent. In this technology, due to the lack of precise control for the conducting of cigarette oil, the individual differences between products are large and the cigarette oil is prone to leak, the consumption experience is poor.

SUMMARY

In order to solve the problems existing in the prior art, the present invention provides an air-liquid exchange element, the air-liquid exchange element comprises an air-liquid exchange element capillary pore axially penetrating through the air-liquid exchange element and an air-liquid exchange element body constituting a peripheral wall of the air-liquid exchange element capillary pore, the air-liquid exchange element body is made by bonding fibers.

Further, the maximum inscribed circle diameter of the minimum cross section of the air-liquid exchange element capillary pore is 0.05 mm to 2.0 mm.

Further, the fibers are bicomponent fibers with a sheath-core structure.

Further, a melting point of a core of the bicomponent fibers is higher than a melting point of a skin by at least 20° C.

Further, the skin of the bicomponent fibers is polyethylene, polypropylene, polylactic acid, polybutylene succinate, low melting point polyester copolyester, polyethylene terephthalate, polytrimethylene terephthalate, polybutylene terephthalate, a copolymer of butylene adipate and butylene terephthalate, polyamide.

The present invention further provides an aerosol cartridge, which comprises at least the air-liquid exchange element according to any embodiment of the present invention.

Further, the aerosol cartridge further comprises a liquid storage element and an atomizer, the atomizer comprises an atomizer wicking element and a heater.

Further, at least one the air-liquid exchange element connects to the liquid storage element and the atomizer wicking element.

Further, at least one the air-liquid exchange element capillary pore communicates with the liquid storage element and the atomizer wicking element.

Further, an opening of an end portion of the air-liquid exchange element capillary pore which is in communication with the atomizer wicking element is blocked by the atomizer wicking element, so that external air cannot directly enter the air-liquid exchange element capillary pore.

Further, the aerosol cartridge further comprises a relay wicking element, the relay wicking element is connected to the air-liquid exchange element and the atomizer wicking element.

Further, the air-liquid exchange element capillary pore is in communication with the relay wicking element, and an opening of one end portion of the air-liquid exchange element capillary pore is blocked by the relay wicking element, so that external air cannot directly enter the air-liquid exchange element capillary pore.

Further, the atomizer wicking element does not directly contact with the liquid stored in the liquid storage element.

Further, the atomizer wicking element directly contacts with the liquid stored in the liquid storage element.

The air-liquid exchange element according to the present invention is small in size and simple in structure, and is very suitable for using in an aerosol cartridge with a small space. The aerosol cartridge using the air-liquid exchange element is suitable for atomizing or vaporizing various liquids, such as atomizing e-liquid of the electronic cigarettes, atomizing the drug solution, and the like. The aerosol cartridge having the air-liquid exchange element according to the present invention is simple in structure, low in cost, easy to automate, and has a good leak-proof performance, can effectively control the liquid release, thereby improving the consistency of product performance. In order to make the above-mentioned content of the present invention more obvious and easier to understand, preferred embodiments are hereinafter described in detail with reference to the accompanying drawings.

BRIEF DESCRIPTION OF THE DRAWINGS

One or more embodiments are illustrated by way of example with reference to the pictures in the corresponding drawings, which do not constitute a limitation on the embodiments, elements having the same reference numerals in the accompanying drawings are represented as similar elements, unless specifically stated, the figures in the drawings do not constitute a proportion limitation.

DESCRIPTION OF THE EMBODIMENTS

Figure 1A:
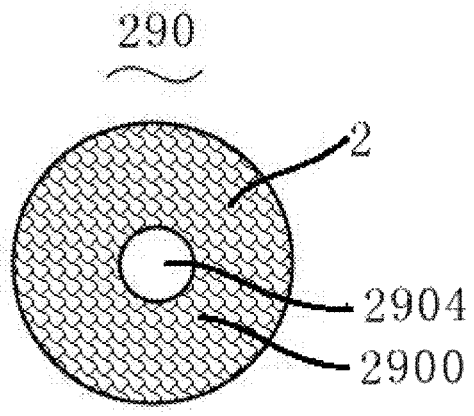
FIG. 1*a* shows a schematic cross-sectional view of an air-liquid exchange element according to the first embodiment of the present invention.

The embodiments of the present invention are described below by way of specific embodiments, and those skilled in the art can readily understand other advantages and functions of the present invention from the disclosure of the present invention.

Exemplary embodiments of the present invention will now be described with reference to the accompanying drawings; however, the invention may be embodied in many different forms and is not limited to the embodiments described herein, which are provided for the purpose of providing a detailed and complete disclosure of the present invention, and fully conveying the scope of the invention to those skilled in the art. The terminology shown in the exemplary embodiments in the drawings is not intended to be limiting of the present invention. In the drawings, the same elements/components generally use the same or similar reference numerals.

As used herein, the terms including scientific and technical terms have the meanings commonly understood to one skilled in the art, unless otherwise indicated. In addition, it is to be understood that a term defined in commonly used dictionaries should be understood to have a consistent meaning in the context of its associated domain and should not be interpreted as an idealized or overly formal meaning.

The First Embodiment

FIG. 1*a* shows a schematic cross-sectional view of an air-liquid exchange element according to the first embodiment of the present invention.

As shown in FIG. 1*a*, an air-liquid exchange element 290 according to the present invention comprises an air-liquid exchange element capillary pore 2904 axially penetrating through the air-liquid exchange element 290 and an air-liquid exchange element body 2900 constituting a peripheral wall of the air-liquid exchange element capillary pore 2904, the air-liquid exchange element body 2900 is made by bonding fibers.

Preferably, the air-liquid exchange element 290 is a columnar body having the air-liquid exchange element capillary pore 2904 axially penetrating through the air-liquid exchange element 290, such as a cylinder, an elliptical cylinder and a square cylinder and the like. Preferably, the air-liquid exchange element capillary pore 2904 is arranged coaxial to the central axis of the columnar body. The cross-section of the air-liquid exchange element capillary pore 2904 may also be various geometric shapes, such as circular, rectangular, elliptical, etc.

In the present embodiment, the air-liquid exchange element 290 comprises an air-liquid exchange element body 2900 with a circular cross-section and an air-liquid exchange element capillary pore 2904 axially penetrating through the air-liquid exchange element body 2900, the cross-section of the air-liquid exchange element capillary pore 2904 is circular. The maximum inscribed circle diameter of the minimum cross-section of the air-liquid exchange element capillary pore 2904 is 0.05 mm to 2.0 mm, such as 0.05 mm, 0.1 mm, 0.2 mm, 0.3 mm, 0.4 mm, 0.5 mm, 0.6 mm, 0.7 mm, 0.8 mm, 0.9 mm, 1.0 mm, 1.2 mm, 1.5 mm, 2.0 mm, etc., preferably is 0.2 mm to 1.2 mm. The smaller cross-section of the air-liquid exchange element capillary pore 2904 is suitable for atomized liquid having lesser viscosity, or an application having a smaller atomization amount; the larger cross-section of air-liquid exchange element capillary pore 2904 is suitable for the atomized liquid having higher viscosity, or an application having a larger atomization amount. When the maximum inscribed circle diameter of the minimum cross-section of the air-liquid exchange element capillary pore 2904 is less than 0.05 mm, the processing is difficult, and the cost performance is too poor. When the maximum inscribed circle diameter of the minimum cross-section of the air-liquid exchange element capillary pore 2904 is greater than 2.0 mm, the capillary pore is too large, it is difficult to ensure a good air-liquid exchange effect, and the air-liquid exchange element capillary pore 2904 is too large to cause the air-liquid exchange element 290 to be too large, which is difficult to use in an aerosol cartridge with a small size.

The air-liquid exchange element 290 is made by bonding fibers and has a good wicking performance. The fibers may be filaments or staple fibers. The fibers made into the air-liquid exchange element 290 may be monocomponent fiber or bicomponent fibers or a mixture of both. The air-liquid exchange element 290 may be made by bonding monocomponent fiber by a binder or a plasticizer, or may be made by bonding bicomponent fibers with a skin-core structure or a parallel structure. The air-liquid exchange element 290 is preferably made by thermally bonding bicomponent fibers 2 with the skin-core structure. Since no binder or plasticizer is added during thermal bonding, it is beneficial to obtain pure products and reduce the costs. The fibers from which the air-liquid exchange element 290 is made have a fineness of 1 to 30 denier, preferably 2 to 10 denier.

Figure 1B:
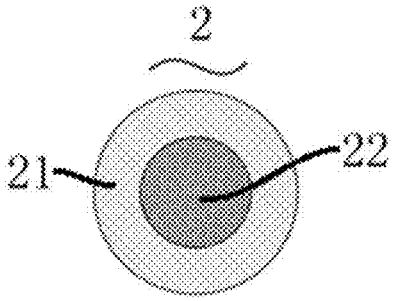
FIG. 1*b* shows an enlarged schematic cross-section view of a bicomponent fibers according to the first embodiment of the present invention.
Figure 1C:
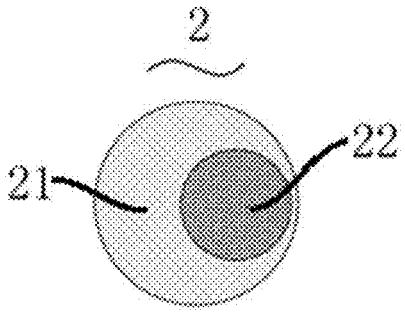
FIG. 1*c* shows another enlarged schematic cross-section view of the bicomponent fibers according to the first embodiment of the present invention.

FIG. 1*b* shows an enlarged schematic cross-section view of a bicomponent fibers according to the first embodiment of the present invention. As shown in FIG. 1*b*, a skin 21 and a core 22 are concentric structure. FIG. 1*c* shows another enlarged schematic cross-section view of the bicomponent fibers according to the first embodiment of the present invention. As shown in FIG. 1*c*, the skin 21 and the core 22 are eccentric structure. The bicomponent fibers 2 are filaments or staple fibers. It can select suitable bicomponent fibers to make into the air-liquid exchange element 290 depending on the performance requirements of the air-liquid exchange element 290.

A melting point of the core 22 of the bicomponent fibers 2 with a skin-core structure is higher than a melting point of the skin 21 by at least 20° C., so that the core 22 can maintain a better rigidity during thermal bonding, which facilitates the formation of the air-liquid exchange element 290. The skin 21 of the bicomponent fibers 2 with the skin-core structure can be a common polymer, such as polyethylene, polypropylene, polylactic acid, polybutylene succinate (PBS for short), low melting point copolyester (co-PET for short), polyethylene terephthalate (PET for short), polytrimethylene terephthalate (PTT for short), polybutylene terephthalate (PBT for short), a copolymer of butylene adipate and butylene terephthalate (PBAT for short), polyamide, etc.

Figure 1D:
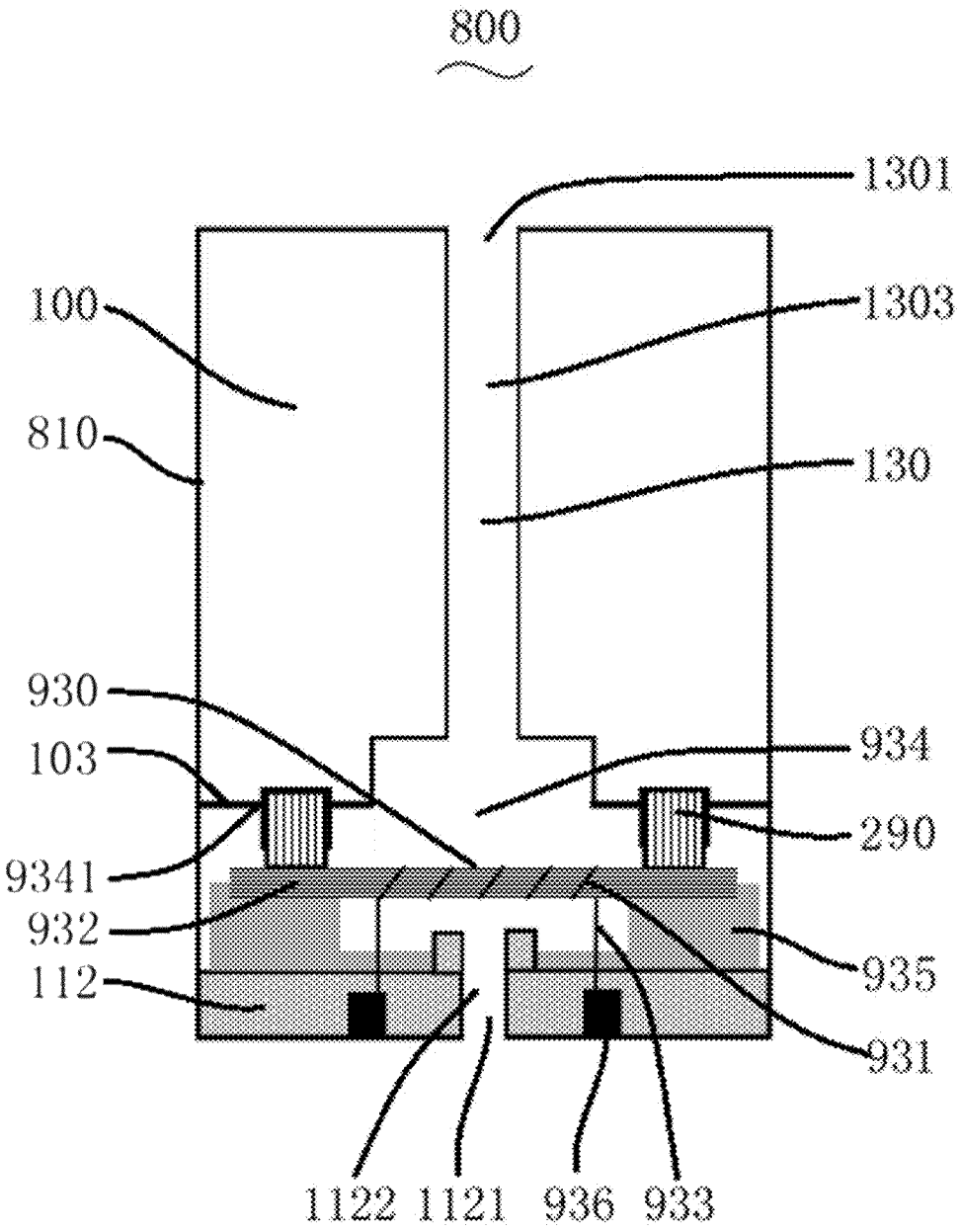
FIG. 1*d* shows a schematic structural view of an aerosol cartridge having the air-liquid exchange element according to the first embodiment of the present invention.
Figure 1E:
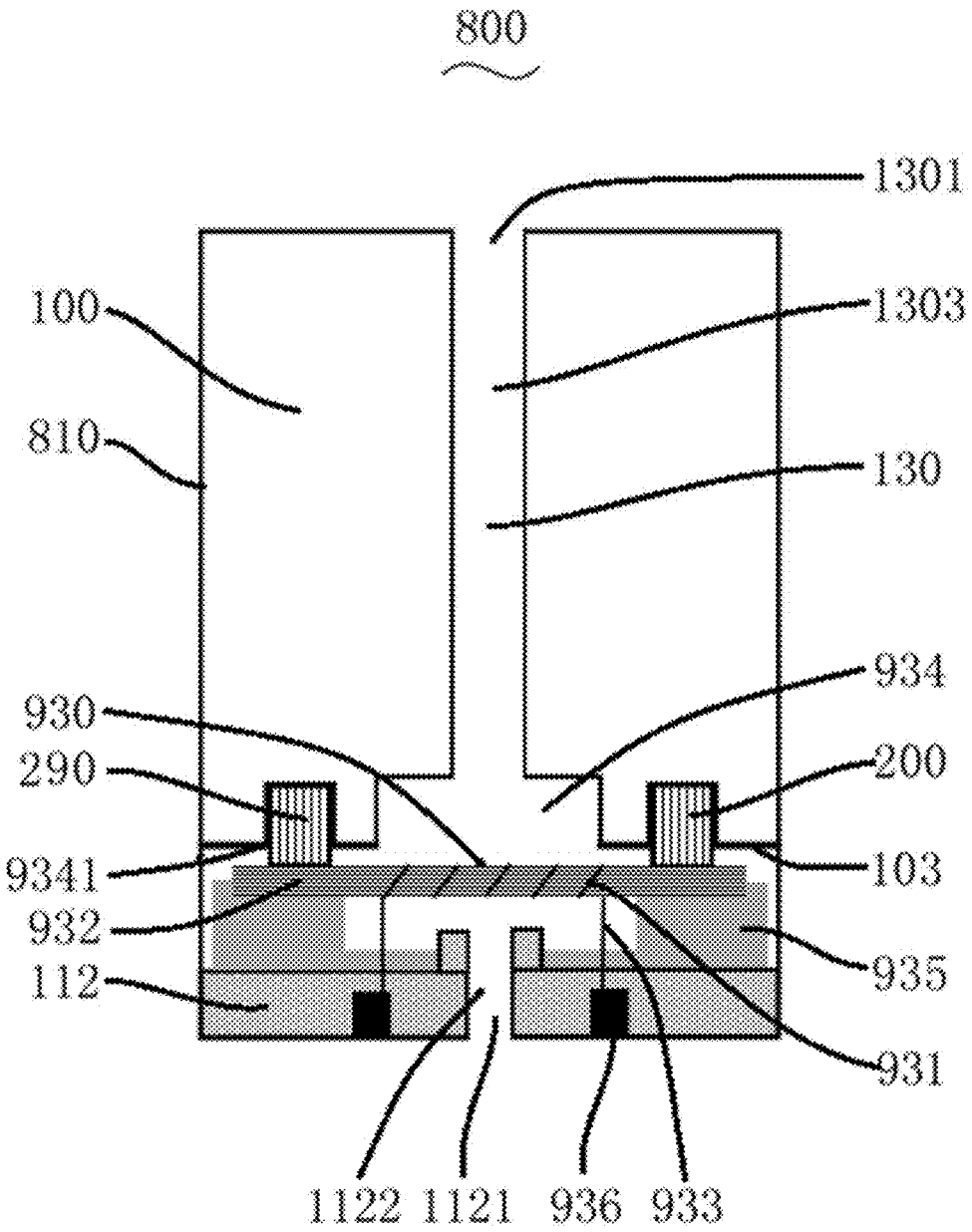
FIG. 1*e* shows another schematic structural view of an aerosol cartridge having the air-liquid exchange element according to the first embodiment of the present invention.

FIG. 1*d* shows a schematic structural view of an aerosol cartridge having the air-liquid exchange element according to the first embodiment of the present invention; and FIG. 1*e* shows another schematic structural view of an aerosol cartridge having the air-liquid exchange element according to the first embodiment of the present invention. As shown in FIG. 1*d* and FIG. 1*e*, an aerosol cartridge 800 having the air-liquid exchange element 290 according to the first embodiment of the present invention comprises the above air-liquid exchange element 290.

The aerosol cartridge 800 further comprises a liquid storage element 100 and an atomizer 930, the atomizer 930 comprises an atomizer wicking element 932 and a heater 931.

At least one the air-liquid exchange element 290 connects to the liquid storage element 100 and the atomizer wicking element 932, the liquid stored in the liquid storage element 100 is transferred to the atomizer wicking element 932 through the air-liquid exchange element 290.

The air-liquid exchange element capillary pore 2904 of at least one the air-liquid exchange element 290 communicates with the liquid storage element 100 and the atomizer wicking element 932, and an opening of an end portion of the air-liquid exchange element capillary pore 2904 which is in communication with the atomizer wicking element 932 is blocked by the atomizer wicking element 932, so that external air can't directly enter the air-liquid exchange element capillary pore 2904.

In the aerosol cartridge 800 according to the present invention, the liquid storage element 100 is a component for storing the atomized liquid. Different liquids, such as e-liquid of electronic cigarettes, can be stored in the liquid storage element 100 depending on the purpose of the application. The cross-section of the liquid storage element 100 may have various shapes, such as circle, elliptical, rectangular, or the like, or may be a combination of various geometric shapes. A liquid inlet which is closed after the liquid is injected can be provided on the liquid storage element 100.

The aerosol cartridge 800 further comprises an aerosol cartridge housing 810, the liquid storage element 100 is provided in the aerosol cartridge housing 810. The liquid storage element 100 can have a liquid storage element through-hole 130 axially penetrating through the liquid storage element 100. The liquid storage element through-hole 130 can be used as an aerosol channel 1303 of the aerosol cartridge 800.

The aerosol cartridge 800 according to the present invention further comprises an atomizing chamber 934, which is a cavity for atomizing or vaporizing the liquid. In the present embodiment, the atomizing chamber 934 is provided at an area between the bottom of the liquid storage element 100, the aerosol cartridge housing 810 and the housing base 112. An atomizer 930 is provided in the atomizing chamber 934, and an air inlet can be provided as required, for example, a base through-hole 1122 is provided in the housing base 112 to serve as an air inlet 1121. The liquid is atomized by the atomizer 930 in the atomizing chamber 934, and escapes from the aerosol cartridge 800 through the aerosol outlet 1301 of the aerosol channel 1303.

The atomizer 930 according to the present invention generally refers to components that can vaporize or atomize the liquid according to usage requirements. The atomizer 930 comprises an atomizer wicking element 932 and a heater 931, the atomizer wicking element 932 can be a capillary material, such as cotton fiber or glass fiber.

The atomizer 930 further comprises a wire 933 and a wire pin 936. The heater 931 is connected to a power source (not shown) through the wire 933 and the wire pin 936.

The bottom of the atomizing chamber 934 can be provided with a support member 935, which may be made of a material such as silicone rubber to enhance contact communication between the air-liquid exchange element 290 and the atomizer wicking element 932. That is beneficial for the atomizer wicking element 932 to block the opening of the end portion of the air-liquid exchange element capillary pore 2904 which is in communication with the atomizer wicking element 932, so that the external air cannot directly enter the air-liquid exchange element capillary pore 2904.

In the present embodiment, a bottom partition plate 103 is provided at the bottom of the liquid storage element 100, which is spaced from the atomizing chamber 934 by the bottom partition plate 103, and one or more partition plate through-holes 9341 communicating with the atomizing chamber 934 and the liquid storage element 100 and penetrating through the bottom partition plate 103 are provided on the bottom partition plate 103. When mounting, the liquid can be injected into the liquid storage element 100 from the partition plate through-hole 9341, then the air-liquid exchange element 290 is mounted in the partition plate through-hole 9341, and components such as the atomizer 930, the supporting member 935 and the housing base 112 are mounted. As shown in FIG. 1*d*, the most part of the air-liquid exchange element 290 can be located in the atomizing chamber 934; as shown in FIG. 1*e*, the most part of the air-liquid exchange element 290 can also be located in the liquid storage element 100. As shown in FIG. 1*d*, in the present embodiment, two air-liquid exchange elements 290 may be used to respectively connect to two ends of the atomizer wicking element 932; as shown in FIG. 1*e*, one air-liquid exchange element 290 and one ordinary wicking element 200 made by bonding fibers may also be used to respectively connect to two ends of the atomizer wicking element 932, the ordinary wicking element 200 does not contain the air-liquid exchange element capillary pores 2904, which is convenient to manufacture and low in cost.

The ordinary wicking element 200 may also be made of any porous material, and is a wicking element which conducting the liquid by the capillary force caused by the porous property of the porous material, but doesn't contain the air-liquid exchanging element capillary pore 2904. The porous material may include sponge, bonded fiber, sintered powdered plastic, etc.

In the present embodiment, the atomizer wicking element 932 does not directly contact with the liquid stored in the liquid storage element 100.

After assembly of the aerosol cartridge 800 is completed, due to the capillary actions of the air-liquid exchange element 290 and the atomizer wicking element 932, the liquid stored in the liquid storage element 100 is conducted to the atomizer wicking element 932 through the air-liquid exchange element 290, and as the liquid stored in the liquid storage element 100 is conducted out, a negative pressure difference is formed between the inside of the liquid storage element 100 and the outside. When the negative pressure difference between the inside of the liquid storage element 100 and the outside is high enough, external air can enter the liquid storage element 100 through the air-liquid exchange element capillary pore 2904 of the air-liquid exchange element 290, but due to the fact that the atomizer wicking element 932 blocks the opening of the end portion of the air-liquid exchange element capillary pore 2904 of the air-liquid exchange element 290 which is in communication with the atomizer wicking element 932, so that the external air can't directly entering the air-liquid exchange element capillary pore 2904, the external air must pass through the atomizer wicking element 932 to enter the air-liquid exchange element capillary pore 2904 of the air-liquid exchange element 290, and finally enter the liquid storage element 100. The capillary force of the atomizer wicking element 932 decreases as the liquid content therein increases, until the negative pressure difference between the inside of the liquid storage element 100 and the outside reaches a balanced state. In the balanced state, the atomizer wicking element 932 is in an unsaturated state, thus it has a ability to further absorb liquid, at the same time, the risk of oil explosion caused by excessive liquid content in the atomizer wicking element 932 during atomization is reduced.

When the liquid stored in the atomizer wicking element 932 is atomized and thus is consumed, the capillary force of the atomizer wicking element 932 increases, the atomizer wicking element 932 performs air-liquid exchanging with the liquid storage element 100 through the air-liquid exchange element 290 until the balanced state is reached again.

When environment temperature rises or outside atmospheric pressure decreases, the air in the liquid storage element 100 expands, the liquid stored in the liquid storage element 100 is conducted out, the atomizer wicking element 932 which is in the unsaturated state can absorb the liquid from the liquid storage element 100 through the air-liquid exchange element 290, thereby reducing the risk of liquid leakage from the aerosol cartridge 800 due to the rise of the environment temperature or the decrease of the outside atmospheric pressure. If the environment temperature or the outside atmospheric pressure is back to the original state, since the atomizer wicking element 932 blocks the opening of the end portion of the air-liquid exchange element capillary pore 2904 of the air-liquid exchange element 290 which is in communication with the atomizer wicking element 932, so that the external air can't directly enter the air-liquid exchange element capillary pore 2904, some of liquid in the atomizer wicking element 932 enters the liquid storage element 100 through the air-liquid exchange element 290 prioritizing over the outside air. That facilitates the liquid flowing back and forth between the liquid storage element 100 and the atomizer wicking element 932 when the environment temperature or pressure changes, thereby reducing the risk of liquid leakage from the aerosol cartridge 800 during daily use. In order to reduce the risk of liquid leakage from the aerosol cartridge during long-term storage and transportation, the aerosol outlet 1301 and the air inlet 1121 of the aerosol cartridge can be sealed by such as mounting a silicone plug.

The Second Embodiment

Figure 2A:
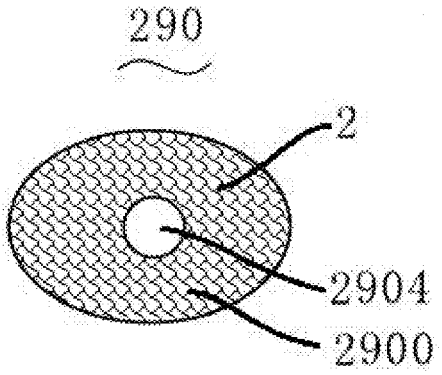
FIG. 2*a* shows a schematic cross-sectional view of an air-liquid exchange element according to the second embodiment of the present invention.
Figure 2B:
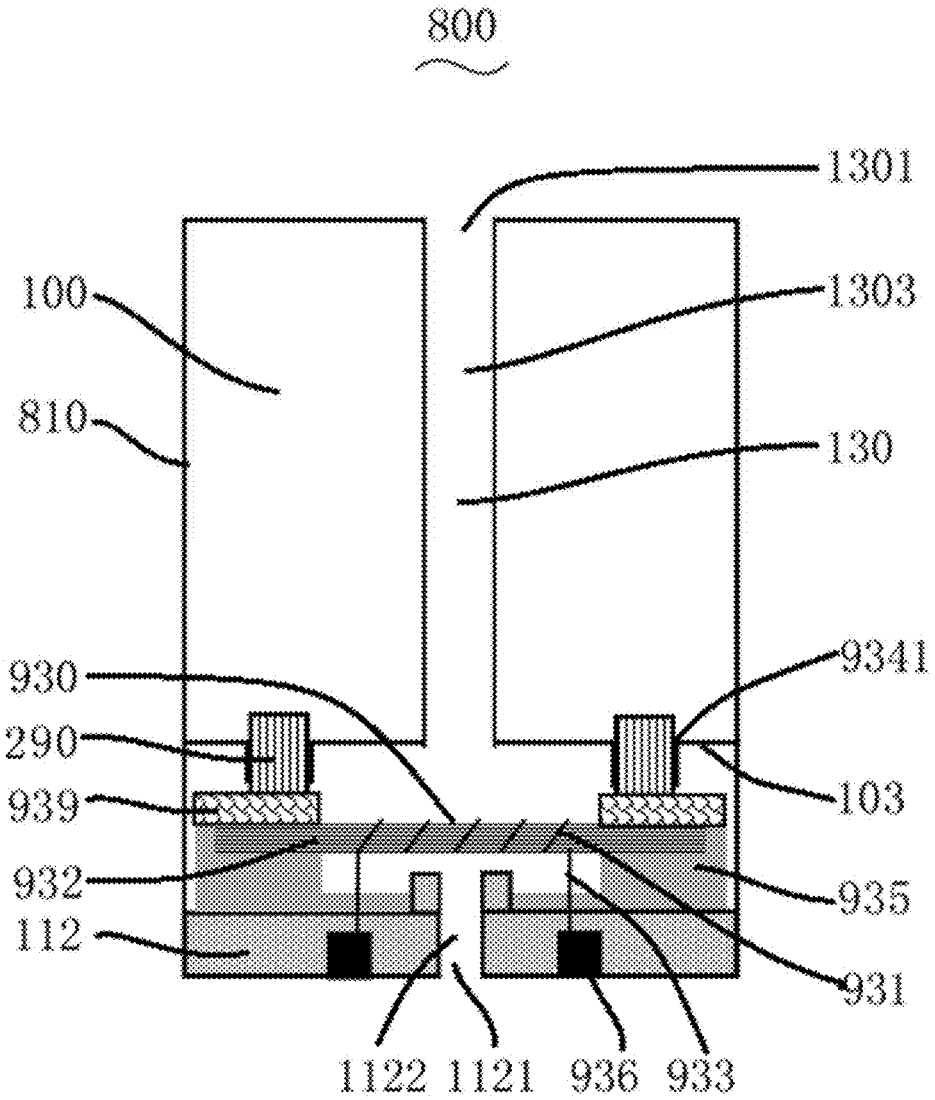
FIG. 2*b* shows a schematic structural view of an aerosol cartridge having the air-liquid exchange element according to the second embodiment of the present invention.

FIG. 2*a* shows a schematic cross-sectional view of an air-liquid exchange element according to the second embodiment of the present invention; and FIG. 2*b* shows a schematic structural view of an aerosol cartridge having the air-liquid exchange element according to the second embodiment of the present invention. The structure of the present embodiment is similar to that of the first embodiment, and the same parts as the first embodiment will not be repeated in the description of this embodiment.

As shown in FIG. 2*a*, an air-liquid exchange element 290 according to the present invention comprises an air-liquid exchange element capillary pore 2904 axially penetrating through the air-liquid exchange element 290 and an air-liquid exchange element body 2900 constituting a peripheral wall of the air-liquid exchange element capillary pore 2904, the air-liquid exchange element body 2900 is made by bonding fibers.

In the present embodiment, the air-liquid exchange element 290 comprises an air-liquid exchange element body 2900 with an elliptical cross-section and an air-liquid exchange element capillary pore 2904 axially penetrating through the air-liquid exchange element body 2900, the cross-section of the air-liquid exchange element capillary pore 2904 is circular. The maximum inscribed circle diameter of the minimum cross-section of the air-liquid exchange element capillary pore 2904 is 0.05 mm to 2.0 mm, such as 0.05 mm, 0.1 mm, 0.2 mm, 0.3 mm, 0.4 mm, 0.5 mm, 0.6 mm, 0.7 mm, 0.8 mm, 0.9 mm, 1.0 mm, 1.2 mm, 1.5 mm, 2.0 mm, etc., preferably 0.2 mm to 1.2 mm.

The air-liquid exchange element 290 is made by bonding fibers and has a good wicking performance. The fibers may be filaments or staple fibers. In the present embodiment, the air-liquid exchange element 290 is preferably made by thermally bonding bicomponent fibers 2 with a skin-core structure, and the fibers preferably have a fineness of 2 to 10 denier. A melting point of a core 22 of the bicomponent fibers 2 with the skin-core structure is higher than a melting point of a skin 21 by at least 20° C., so that the core 22 can maintain a better rigidity during thermal bonding, which facilitates the formation of the air-liquid exchange element 290. The skin 21 of the bicomponent fibers 2 with the skin-core structure can be a common polymer, such as polyethylene, polypropylene, polylactic acid, polybutylene succinate (PBS for short), low melting point copolyester (co-PET for short), polyethylene terephthalate (PET for short), polytrimethylene terephthalate (PTT for short), polybutylene terephthalate (PET for short), a copolymer of butylene adipate and butylene terephthalate (PBAT for short), polyamide, etc., preferably polylactic acid, PBS or PBAT which is easily degraded in nature.

As shown in FIG. 2*b*, an aerosol cartridge 800 having the air-liquid exchange element 290 according to the second embodiment of the present invention comprises a liquid storage element 100, an atomizer 930 and an air-liquid exchange element 290, the atomizer 930 comprises an atomizer wicking element 932 and a heater 931.

In the present embodiment, the aerosol cartridge 800 further comprises a relay wicking element 939, the relay wicking element 939 is connected to the air-liquid exchange element 290 and the atomizer wicking element 932. The air-liquid exchange element capillary pore 2904 is in communication with the relay wicking element 939, an opening of one end portion of the air-liquid exchange element capillary pore 2904 is blocked by the relay wicking element 939, so that external air cannot directly enter the air-liquid exchange element capillary pore 2904.

At least one the air-liquid exchange element 290 connects to the liquid storage element 100 and the relay wicking element 939. The relay wicking element 939 is connected to the air-liquid exchange element 290 and the atomizer wicking element 932, the liquid stored in the liquid storage element 100 is transferred to the atomizer wicking element 932 through the air-liquid exchange element 290 and the relay wicking element 939. The air-liquid exchange element capillary pore 2904 of at least one the air-liquid exchange element 290 communicates with the liquid storage element 100 and the relay wicking element 939, the opening of the end portion of the air-liquid exchange element capillary pore 2904 which is in communication with the relay wicking element 939 is blocked by the relay wicking element 939, so that external air can't directly enter the air-liquid exchange element capillary pore 2904. The relay wicking element 939 may be a porous material made of a polymer, which is easily made into a flat surface, and can better block the opening of the end portion of the air-liquid exchange element capillary pore 2904 of the air-liquid exchange element 290 which is in communication with the relay wicking element 939, thereby improving the leak-proof performance of the aerosol cartridge 800.

The bottom of the atomizing chamber 934 can be provided with a support member 935, which may be made of a material such as silicone rubber to enhance contact communication between the air-liquid exchange element 290, the relay wicking element 939 and the atomizer wicking element 932. That is beneficial for the relay wicking element 939 to block the opening of the end portion of the air-liquid exchange element capillary pore 2904 of the air-liquid exchange element 290 which is in communication with the relay wicking element 939.

In the present embodiment, a bottom partition plate 103 is provided at the bottom of the liquid storage element 100, which is spaced from the atomizing chamber 934 by the bottom partition plate 103, and the bottom partition plate 103 is provided with one or more partition plate through-holes 9341 communicating with the atomizing chamber 934 and the liquid storage element 100 and penetrating through the bottom partition plate 103. When mounting, the liquid can be injected into the liquid storage element 100 from the partition plate through-hole 9341, then the air-liquid exchange element 290 is mounted in the partition plate through-hole 9341, and components such as the atomizer 930, the relay wicking element 939, the supporting member 935 and the housing base 112 are mounted.

After the installation is completed, due to the capillary actions of the air-liquid exchange element 290, the relay wicking element 939 and the atomizer wicking element 932, the liquid stored in the liquid storage element 100 is conducted to the atomizer wicking element 932 through the air-liquid exchange element 290 and the relay wicking element 939, and as the liquid stored in the liquid storage element 100 is conducted out, a negative pressure difference is formed between the inside of the liquid storage element 100 and the outside. When the negative pressure difference between the inside of the liquid storage element 100 and the outside is high enough, external air can enter the liquid storage element 100 through the air-liquid exchange element capillary pore 2904 of the air-liquid exchange element 290, but due to the fact that the relay wicking element 939 blocks the opening of the end portion of the air-liquid exchange element capillary pore 2904 of the air-liquid exchange element 290 which is in communication with the relay wicking element 939, the external air must pass through the relay wicking element 939 to enter the air-liquid exchange element capillary pore 2904 of the air-liquid exchange element 290, and finally enter the liquid storage element 100. The capillary force of the atomizer wicking element 932 decreases as the liquid content therein increases, until the negative pressure difference between the inside of the liquid storage element 100 and the outside reaches a balanced state. In the balanced state, the atomizer wicking element 932 is in an unsaturated state, so it has a ability to further absorb liquid, at the same time, the risk of oil explosion caused by excessive liquid content in the atomizer wicking element 932 during atomization is reduced.

When the liquid stored in the atomizer wicking element 932 is atomized and thus is consumed, the capillary force of the atomizer wicking element 932 increases, the atomizer wicking element 932 performs air-liquid exchanging with the liquid storage element 100 through the relay wicking element 939 and the air-liquid exchange element 290 until the balanced state is reached again.

When environment temperature rises or outside atmospheric pressure decreases, the air in the liquid storage element 100 expands, the liquid stored in the liquid storage element 100 is conducted out, the atomizer wicking element 932 which is in the unsaturated state can absorb the liquid from the liquid storage element 100 through the relay wicking element 939 and the air-liquid exchange element 290, thereby reducing the risk of liquid leakage from the aerosol cartridge 800 due to the rise of the environment temperature or the decrease of the outside atmospheric pressure. If the environment temperature or the outside atmospheric pressure is back to the original state, since the relay wicking element 939 blocks the opening of the end portion of the air-liquid exchange element capillary pore 2904 of the air-liquid exchange element 290 which is in communication with the relay wicking element 939, some of liquid in the relay wicking element 939 and the atomizer wicking element 932 enters the liquid storage element 100 through the air-liquid exchange element 290 prioritizing over the outside air. That facilitates the liquid flowing back and forth between the liquid storage element 100 and the relay wicking element 939 and the atomizer wicking element 932 when the environment temperature or pressure changes, thereby reducing the risk of liquid leakage from the aerosol cartridge 800 during daily use.

The Third Embodiment

Figure 3:
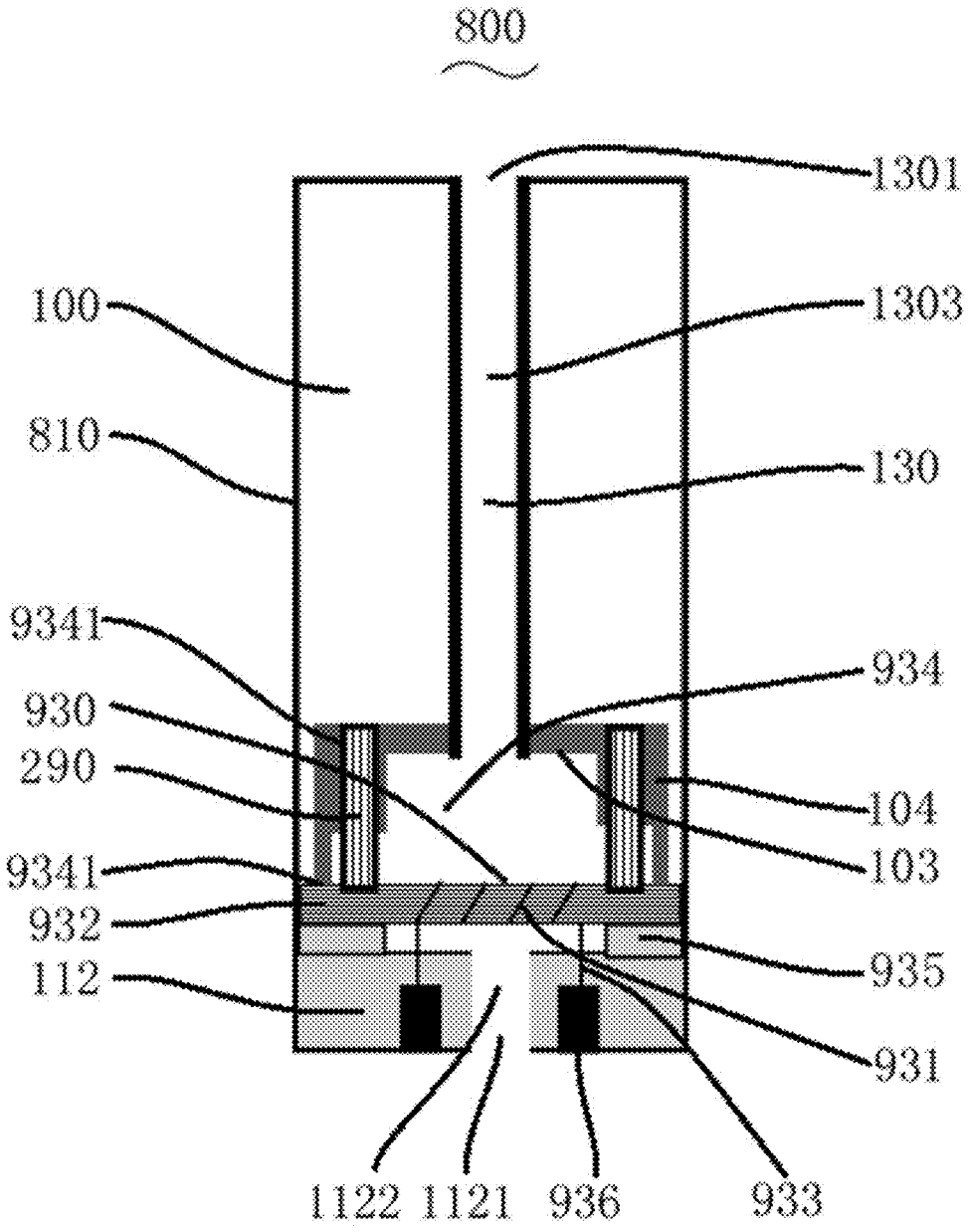
FIG. 3 shows a schematic structural view of an aerosol cartridge having an air-liquid exchange element according to the third embodiment of the present invention.

FIG. 3 shows a schematic structural view of an aerosol cartridge having an air-liquid exchange element according to the third embodiment of the present invention. The structure of the present embodiment is similar to that of the first embodiment, and the same parts as the first embodiment will not be repeated in the description of this embodiment.

An air-liquid exchange element 290 according to the present invention comprises an air-liquid exchange element capillary pore 2904 axially penetrating through the air-liquid exchange element 290 and an air-liquid exchange element body 2900 constituting a peripheral wall of the air-liquid exchange element capillary pore 2904, the air-liquid exchange element body 2900 is made by bonding fibers.

As shown in FIG. 3, an aerosol cartridge 800 having the air-liquid exchange element 290 according to the third embodiment of the present invention comprises a liquid storage element 100, an atomizer 930 and an air-liquid exchange element 290, the atomizer 930 comprises an atomizer wicking element 932 and a heater 931.

In the present embodiment, a bottom partition plate 103 and a side partition plate 104 are provided at the bottom of the liquid storage element 100, which is spaced from the atomizing chamber 934 by the bottom partition plate 103 and the side partition plate 104, and the bottom partition plate 103 is provided with one or more partition plate through-holes 9341 communicating with the atomizing chamber 934 and the liquid storage element 100 and penetrating through the bottom partition plate 103.

The side partition plate 104 is also provided with two partition plate through-holes 9341 communicating with the atomizing chamber 934 and the liquid storage element 100 and penetrating through the side partition plate 104. Two ends of the atomizer wicking element 932 pass through and block the partition plate through-holes 9341 of the side partition plate 104, and directly contact the liquid stored in the liquid storage element 100. An opening of an end portion of the air-liquid exchange element capillary pore 2904 of the air-liquid exchange element 290 which is in communication with the atomizer wicking element 932 is blocked by the atomizer wicking element 932, so that external air can't directly enter the air-liquid exchange element capillary pore 2904.

In the present embodiment, the air-liquid exchange element 290 has a wicking effect and a breath effect. Due to the fact that the two ends of the atomizer wicking element 932 are in direct contact with the liquid stored in the liquid storage element 100, it can be ensured that the atomizer 930 obtains sufficient liquid supply during atomization process. In the present embodiment, two air-liquid exchange elements 290 are preferably used, but only one air-liquid exchange element 290 can also be used.

In the present embodiment, the end surface of the air-liquid exchange element 290 can compress the two ends of the atomizer wicking element 932 to ensure that the atomizer wicking element 932 blocks the opening of the end portion of the air-liquid exchange element capillary pore 2904.

Preferably, the inner peripheral wall of the partition plate through-hole 9341 of the side partition plate 104 compresses or tightens the atomizer wicking element 932, thereby ensuring that the atomizer wicking element 932 blocks the partition through-hole 9341, and preventing external air from leaking into the liquid storage element 100 from the partition plate through-hole 9341.

In the present embodiment, the atomizer 930 can be supported by the support member 935. Certainly, the support member 935 does not need to be provided, the atomizer 930 is directly supported by the housing base 112. The partition plate through-hole 9341 of the side partition plate 104 can also be partially formed on the support member 935 or the housing base 112.

After assembly of the aerosol cartridge 800 is completed, the liquid stored in the liquid storage element 100 is conducted to the atomizer wicking element 932, as the liquid stored in the liquid storage element 100 is conducted out, a negative pressure difference is formed between the inside of the liquid storage element 100 and the outside. When the negative pressure difference between the inside of the liquid storage element 100 and the outside is high enough, external air can enter the liquid storage element 100 through the air-liquid exchange element capillary pore 2904. But due to the fact that the atomizer wicking element 932 blocks the opening of the end portion of the air-liquid exchange element capillary pore 2904 which is in communication with the atomizer wicking element 932, so that the external air can't directly entering the air-liquid exchange element capillary pore 2904, the external air must pass through the atomizer wicking element 932 to enter the air-liquid exchange element capillary pore 2904, and finally enter the liquid storage element 100.

The capillary force of the atomizer wicking element 932 decreases as the liquid content therein increases, until the negative pressure difference between the inside of the liquid storage element 100 and the outside reaches a balanced state. In the balanced state, the atomizer wicking element 932 is in an unsaturated state, thus it has a ability to further absorb liquid, at the same time, the risk of oil explosion caused by excessive liquid content in the atomizer wicking element 932 during atomization is reduced.

When the liquid stored in the atomizer wicking element 932 is atomized and thus is consumed, the capillary force of the atomizer wicking element 932 increases, the atomizer wicking element 932 replenishes liquid from the liquid storage element 100, the liquid storage element 100 replenishes air through the air-liquid exchange element 290, until the balanced state is reached again.

When environment temperature rises or outside atmospheric pressure decreases, the air in the liquid storage element 100 expands, the liquid stored in the liquid storage element 100 is conducted out, the atomizer wicking element 932 which is in the unsaturated state can absorb the liquid from the liquid storage element 100, thereby reducing the risk of liquid leakage from the aerosol cartridge 800 due to the rise of the environment temperature or the decrease of the outside atmospheric pressure. If the environment temperature or the outside atmospheric pressure is back to the original state, since the atomizer wicking element 932 blocks the opening of the end portion of the air-liquid exchange element capillary pore 2904 which is in communication with the atomizer wicking element 932, so that the external air can't directly enter the air-liquid exchange element capillary pore 2904, some of liquid stored in the atomizer wicking element 932 enters the liquid storage element 100 through the atomizer wicking element 932 or the air-liquid exchange element 290 prioritizing over the outside air. That facilitates the liquid flowing back and forth between the liquid storage element 100 and the atomizer wicking element 932 when the environment temperature or pressure changes, thereby reducing the risk of liquid leakage from the aerosol cartridge 800 during daily use. In summary, the air-liquid exchange element 290 according to the present invention is simple in structure and is suitable for using in the aerosol cartridge 800 or an atomization device having a small volume. The aerosol cartridge 800 using the air-liquid exchange element 290 is suitable for applications like electronic cigarettes, and can also be used for quantitative atomization of inhaled drug solution in the medical field. The aerosol cartridge 800 using the air-liquid exchange element 290 has a compact structure and a good leak-proof performance, and can uniformly control liquid release. If an airflow sensor is provided in the external control device, the atomization of the liquid can be controlled depending on air flow, which is more convenient to use.

In addition, the foregoing embodiments of the present disclosure are only intended to illustrate the principle and advantages of the present disclosure rather than limiting the present disclosure. Those skilled in the art can make modifications or changes to the foregoing embodiments without departing from the spirit and scope of the present disclosure. Therefore, all equivalent modifications or changes made by those skilled in the art without departing from the spirit and technical concepts disclosed by the present disclosure shall still be covered by the claims of the present disclosure.

What is claimed is:

1. An air-liquid exchange element, comprising:

an air-liquid exchange element capillary pore axially penetrating through the air-liquid exchange element; and an air-liquid exchange element body constituting a peripheral wall of the air-liquid exchange element capillary pore, wherein the air-liquid exchange element body is made by bonding fibers, the peripheral wall of the air-liquid exchange element capillary pore is formed solely by the air-liquid exchange element body, the maximum inscribed circle diameter of the minimum cross section of the air-liquid exchange element capillary pore is 0.05 mm to 2.0 mm, and the air-liquid exchange element conducts gas through the air-liquid exchange element capillary pore.

2. The air-liquid exchange element of claim 1, wherein the fibers are bicomponent fibers with a sheath-core structure.

3. The air-liquid exchange element of claim 2, wherein a melting point of a core of the bicomponent fibers is higher than a melting point of a skin by at least 20° C.

4. The air-liquid exchange element of claim 2, wherein a skin of the bicomponent fibers is polyethylene, polypropylene, polylactic acid, polybutylene succinate, low melting point copolyester, polyethylene terephthalate, polytrimethylene terephthalate, polybutylene terephthalate, a copolymer of butylene adipate and butylene terephthalate, polyamide.

5. An aerosol cartridge, wherein the aerosol cartridge at least comprises the air-liquid exchange element as claimed in claim 1.

6. The aerosol cartridge of claim 5, wherein the aerosol cartridge further comprises a liquid storage element and an atomizer, and the atomizer comprises an atomizer wicking element and a heater.

7. The aerosol cartridge of claim 6, wherein the air-liquid exchange element connects to the liquid storage element and the atomizer wicking element.

8. The aerosol cartridge according to claim 6, wherein the air-liquid exchange element capillary pore communicates with the liquid storage element and the atomizer wicking element.

9. The aerosol cartridge according to claim 8, wherein an opening of an end portion of the air-liquid exchange element capillary pore which is in communication with the atomizer wicking element is blocked by the atomizer wicking element, so that an external air cannot directly enter the air-liquid exchange element capillary pore.

10. The aerosol cartridge of claim 6, wherein the aerosol cartridge further comprises a relay wicking element, and the relay wicking element is connected to the air-liquid exchange element and the atomizer wicking element.

11. The aerosol cartridge according to claim 10, wherein the air-liquid exchange element capillary pore is in communication with the relay wicking element, and an opening of one end portion of the air-liquid exchange element capillary pore is blocked by the relay wicking element, so that an external air cannot directly enter the air-liquid exchange element capillary pore.

12. The aerosol cartridge of claim 8, wherein the atomizer wicking element does not directly contact with a liquid stored in the liquid storage element.

13. The aerosol cartridge of claim 8, wherein the atomizer wicking element directly contacts with a liquid stored in the liquid storage element.

* * * * *